US006767850B1

(12) United States Patent
Tebbe

(10) Patent No.: US 6,767,850 B1
(45) Date of Patent: Jul. 27, 2004

(54) TWO DIMENSIONAL TEXTILE MATERIAL

(75) Inventor: Gerold Tebbe, Monte Carlo (MC)

(73) Assignee: Deotexis Inc., New York, NY (US)

( * ) Notice: Subject to any disclaimer, the term of this patent is extended or adjusted under 35 U.S.C. 154(b) by 0 days.

(21) Appl. No.: 09/573,517

(22) Filed: May 17, 2000

(30) Foreign Application Priority Data

May 21, 1999 (DE) ..... 199 23 575

(51) Int. Cl.[7] ..... B32B 5/18; B32B 5/22

(52) U.S. Cl. ..... 442/76; 442/85; 442/305; 442/307; 442/325; 428/913

(58) Field of Search ..... 428/913; 442/76, 442/85, 305, 307, 325

(56) References Cited

U.S. PATENT DOCUMENTS 3,857,753 A * 12/1974 Hansen ..... 156/145
4,541,426 A * 9/1985 Webster ..... 602/42
5,834,093 A * 11/1998 Challis et al. ..... 383/102
6,274,237 B1 * 8/2001 Nakajima et al. ..... 428/370

FOREIGN PATENT DOCUMENTS

DE 19619858 A1 11/1997

* cited by examiner

*Primary Examiner*—Elizabeth M. Cole
*Assistant Examiner*—Norca L. Torres
(74) *Attorney, Agent, or Firm*—Factor & Partners

(57) ABSTRACT

A flat textile material (10) has an upper side and an underside and is used, in particular, as a clothing fabric. For the purpose of controlling the permeability of the textile material (10), control elements (34, 36; 16, 18) are provided which are deformable by an environmental parameter. Media whose permeation is controlled thus are, for example, fluids or light. Possible environmental parameters are, for example, the temperature or the air humidity. It is thus possible to make, for example, textile materials whose breathing activity increases with the body temperature of the user.

60 Claims, 7 Drawing Sheets

TWO DIMENSIONAL TEXTILE MATERIAL

BACKGROUND OF THE INVENTION

The invention concerns a flat textile material as will be described further herein.

In respect of permeability, textile materials can be divided into three groups, namely, permeable, impermeable and selectively permeable materials. A fluid is selected in this case as an example of a medium whose passage through a textile material is to be considered. Both textile materials which are permeable to fluid (normal fabric) and textile materials which are impermeable to fluid (fabric with closed pores) have been known for a long time. An example of a textile material which is selectively permeable to fluid is cotton or corresponding mixed fabrics coated with PTFE, known by the brand name of Gore-Tex.

The permeability of known textile materials is dependent on environmental parameters such as temperature and air humidity. This prevents an adjustment of the permeability as a result of a variation of such an environmental parameter. For example, the pore size of a Gore-Tex fabric, which is not dependent on environmental parameters, results in a compromise between the wind-tightness and the water vapour permeability of this material. If the outside temperature is low, however, it is desirable to have a wind-tight textile material, i.e., with more closed pores, whereas if the outside temperature is higher it is desirable to have a more actively breathing textile material which is permeable to water vapour, with larger, more open pores.

The object of the present invention is to develop a textile material according to the the claims in such a way that its permeability is variable in dependence on environmental parameters.

BRIEF SUMMARY OF THE INVENTION

This object is achieved, according to the invention, by a textile material with the features stated in the claims.

The elements which control the permeability of the textile material define openings or pores in the textile material according to the invention whose inside width varies in dependence on environmental parameters. For example, if the environmental parameter is the temperature, then textile materials can be made in such a way that, for example, their permeability increases either with increasing temperature or with decreasing temperature. Permeability which increases with increasing temperature is desired in the case of clothing, for example, particularly in sports and leisure clothing. When the body temperature of the wearer increases, as a result of either the wearer's own exertion or increasing outside temperature, the enlarging openings can increase the breathing activity of the clothing made from such a textile material. A reduction in the permeability of an item of clothing at increased temperature can be used, for example, for therapeutic purposes.

If the permeability of the textile material in respect of light is considered as a further example, a textile material whose light transmission decreases with increased temperature (or intensified insolation) can be used for beach clothing or sun screens, or also as a textile material which can be used for covering greenhouses.

For certain applications, it can also be advantageous that, starting from a predefined temperature, the permeability of the textile material increases or decreases in the case of both an increase and a decrease in the temperature, relative to the predefined temperature. Such textile materials can be used, for example, as covers for industrial installations. A textile material with a permeability which, starting from a predefined temperature, decreases in the case of both an increase and a decrease in the temperature can, for example, prevent the emergence of vapours or other fluids which develop in the case of a temperature deviation from a predefined process temperature. The reverse effect, in which the permeability of the textile material increases in the case of both a temperature increase and a temperature decrease in relation to a predefined temperature, can be used, for example, as a controllable filter in chemical fractionation.

The use of control element pairs according to the claims permits the attainment of passage openings of defined sizes, resulting in a defined permeability characteristic. Such a textile material is used, for example, if complete impermeability, e.g. water-tightness, is required in the presence of certain environmental parameters, so that all pores or openings can be closed in a defined manner, down to a passage width of zero.

In the case of a textile material according to the claims, use is made of the fact that the control elements, which are of different material, respond differently to one or more environmental parameters. An example of this is the use of control elements made form materials with differing temperature expansion coefficients. Materials with differing swelling behaviour, i.e., differing volume expansion in dependence on the air humidity, for example, can also be used.

The control elements according to the claims are designed in such a way that a variation of environmental parameters likewise produces different effects on the different control element types, which in turn affects the permeability of the material. If the control elements are of differing geometry, the textile material can also be made from a single material only, which simplifies production.

In the case of the embodiment of the textile material according to the claims, use is made of an effect similar to a bimetallic behaviour. The environmental parameter operating range of the textile material can be predefined through the choice of the value of the environmental parameter at which the layers of material dependent on the environmental parameter are jointed together.

In the case of the textile material designed according to the claims, the volume variation of the capsules/micro-capsules can be used for closing passage channels or openings in the textile material. Preferably, in this case a fluid with a high vapour pressure is used for the filing and a material with good elasticity is used for the elastic enclosure. A material with good elasticity in this case is a material which, when sued as an enclosure for a capsule/microcapsule, permits an enlargement of the diameter of such a capsule/micro-capsule by, for example, a factor of 2 for a temperature increase of 100° C. The permeability characteristic of the textile material can then be adapted to given requirements, depending on the substances selected for the enclosure and the filing.

Preferably, a textile material according to the claims is used, since, in the temperature range which is relevant to the clothing, the vapour pressure is then highly dependent on the temperature and, consequently, the diameter of the capsule/micro-capsule is varied greatly by the temperature.

A sufficiently secure and cost-effective bond between the capsules/micro-capsules and the fibres is achieved by the design of the textile material according to the claims.

In the case of a textile material according to the claims, the permeability can be varied greatly in dependence on an environmental parameter, since the size and the density of the openings can be varied within wide limits.

The design according to the claims results in a closing force which tends to lay the layers of material against one another and which must be overcome by the capsules/micro-capsules which expand in dependence on an environmental parameter. Such a closing force provides for a reversible control of the permeability of the textile material. In addition, the layers of material are securely joined together.

A preferred embodiment of the textile material is that according to the claims. The recesses provided for the capsules/micro-capsules enable the layer of material to lie on one another in a sealing manner when the capsules/micro-capsules have reduced in size, in dependence on an environmental parameter, in such a way that they lie completely in the recesses.

The design of the textile material according to the claims offers the possibility of producing a basic fabric using a conventional manufacturing method and subsequently inserting the capsules/micro-capsules, which then create the permeability, dependent on environmental parameters, of the textile material. In this case, likewise, depending on the thickness of the textile material used and beyond a certain density and size of the capsules/micro-capsules, on average a virtually complete impermeability is achieved if desired.

The design according to the claims can also result in the permeability being highly dependent on one or more environmental parameters. In this case, likewise, the above-mentioned bimetal effect can be exploited in combination with the fabric tongues.

The design according to the clams enables textile material which is controllably permeable to fluid to be produced relatively cheaply. In this case, the main layer of material, apart from the openings in it, is substantially impermeable to fluid. The control thread can then expand in dependence on, for example, temperature or can swell in dependence on air humidity in order to close the openings.

The control element design according to the claims means that the diameter of the control threads varies greatly in dependence on environmental parameters. A fabric can also be made exclusively from such control threads. The gaps between the control threads are then closed or opened by the variation in their diameter, the permeability of the textile material being varied as a result. Alternatively, it is possible, for example, for such a control thread to be inserted through openings of a main material layer, so that these openings are then opened or closed in dependence on environmental parameters.

In the case of the threads being designed according to the claims, the bimetal effect is again used to deform threads.

The design accordingly to the claims does not exploit any special property of environmental parameter dependence of the lacquer coating, but rather its shielding effect in combination with a behaviour of the threads which is dependent on environmental parameters. A range of other materials is therefore available which impart to a thread a deformation which is dependent on environmental parameters.

The embodiment according to the claims can be produced with conventional weaving technology and another embodiment according to the claims with conventional knitting technology. In the case of known knitting machines, some of the supplied threads, e.g. half, can consist of threads which are dependent on environmental parameters and the remainder of threads made from material which is substantially non-dependent on environmental parameters.

A control element according to the claims has a temperature and humidity-dependent expansion which differs from multifilament threads, while having the same dimension.

A textile material according to the claims is characterized by a good wearing comfort. If only one material is used, this also both simplifies the product of the textile material and reduces the problem of the occurrence of electrostatic charge.

The invention is described more fully below using embodiment examples, with reference to the drawing, wherein:

DETAILED DESCRIPTION OF THE INVENTION

Figures 1, 2, 3, 4, 5:
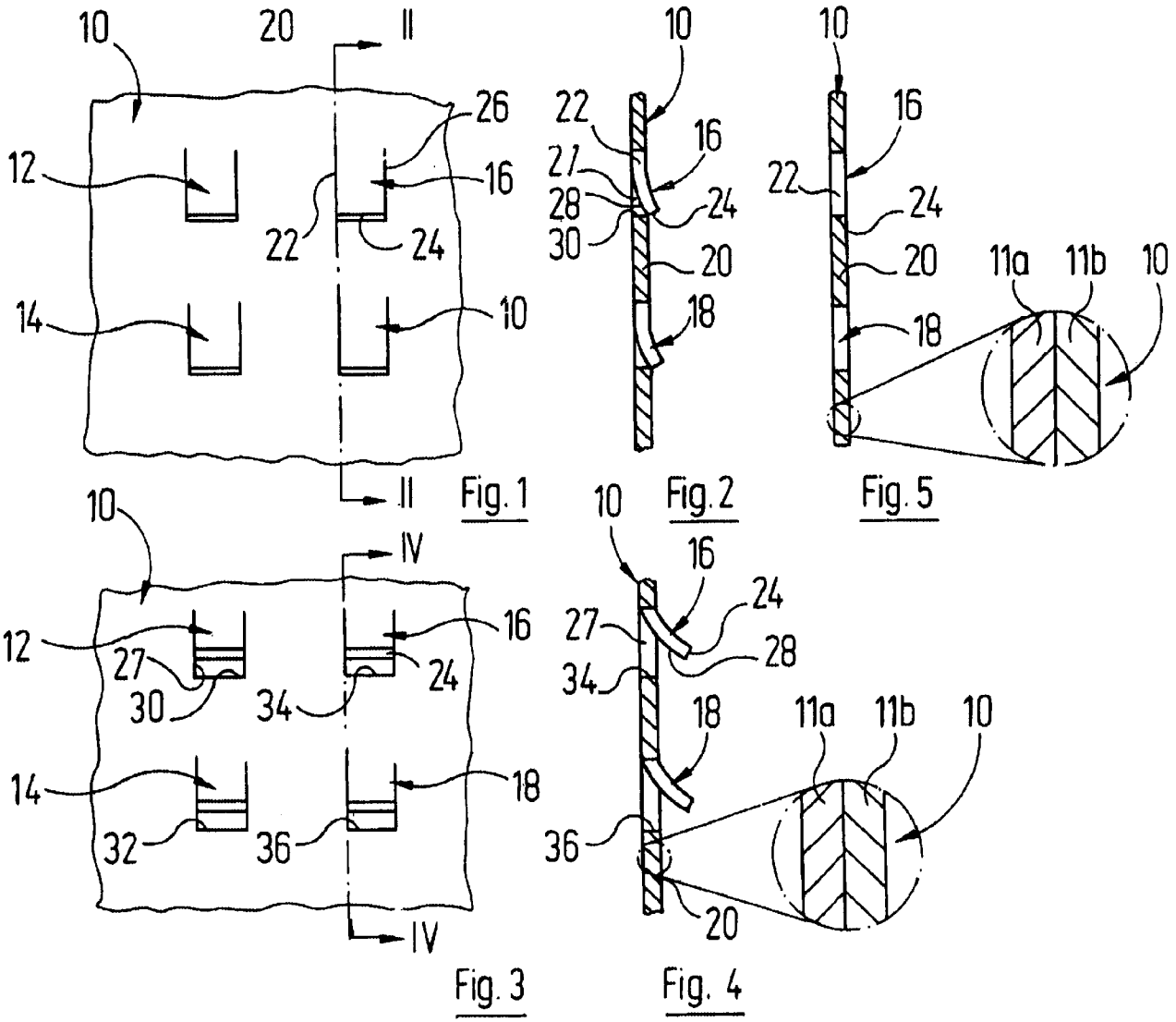
FIG. 1 shows a greatly enlarged top-view of a piece of a textile fabric web, into which there are cut fabric tongues.
FIG. 2 shows a section along line II—II of FIG. 1.
FIG. 3 shows a top-view of the fabric web of FIG. 1, after it has been subjected to an increased temperature.
FIG. 4 shows a section along line IV—IV of FIG. 3.
FIG. 5 shows a representation, similar to FIGS. 2 and 4, of a fabric web similar to the fabric web of FIGS. 1 to 4.

The textile fabric web having the general reference number 10 in the drawing is a flat structure made from a textile material which has a low permeability to fluids, particularly water and water vapour. Such substantially fluid-tight textile materials are, for example, textile fabrics whose pores are closed with an appropriate filling material, e.g. boiled linseed oil, acrylic polymers, ammoniacal copper oxide, caoutchouc or resins.

The fabric web of both this and also the following embodiment examples can be produced, if the production method is not stated explicitly, both by a knitting and a weaving method. Alternatively, the fabric web can also be a non-woven fabric material, i.e., for example, a felt, fleece, textile composite or even a foil.

The textile material shown in FIGS. 1 to 4 is constituted so that when temperature is increased it bends under the action of a mechanical stress induced by the temperature increase. Such a mechanical stress is achieved, for example, by analogy with a bimetal, by a composite construction of the fabric web 10 from two layers of materials 11*a,* 11*b* joined flatly together (cf. the section enlargement of FIG. 4) with differing temperature expansion coefficients.

The piece of the fabric web 10 shown in FIG. 1 has four fabric tongues 12, 14, 16, 18. The fabric tongue 16, which is described here as representative of the other fabric tongues 12, 14 and 18, which are of the same construction, is a rectangular portion of fabric which is joined, at its upper end in FIG. 1, to a main fabric layer 20 of the fabric web 10. The three remaining sides of the fabric tongue 16 are delimited by cut edges 22, 24 and 26. The fabric tongue 16 has been produced by a substantially rectangular cut or punching process, performed in the main fabric layer 20, which has produced the cut edges 22 to 26 in the fabric tongue 16 and a rectangular U-shaped cut edge, denoted in general by the reference 27, in the main fabric layer 20.

As can be seen in combination with FIG. 2, the cut edge 24 projects from the surface of the fabric web 10 defined by the main fabric layer 20.

Such a projection is caused by the fact that, in the case of fabric tongues beyond a certain dimensional ratio between the thickness and typical expansion of the fabric tongue in a relatively stiff textile material, for steric reasons, once the fabric tongue 12 has been raised out of the main fabric layer 20 it can no longer slide back into the main fabric layer. In addition, in the case of the above-mentioned cut or punching process, the fabric tongue 12 can lengthen somewhat due to temporary adhesion to the cutting or stamping tool, which likewise impedes or prevents the fabric tongue 12 from sliding back into the main layer 20.

In the position shown in FIGS. 1 and 2, the cut edge 24 of the fabric tongue 12, with the cut edges 22, 26 and the underside 28 of the fabric tongue 16, sit substantially close to the regions of the main fabric layer 20 which are adjacent to them. Consequently, in this depicted position of the fabric tongues 12 to 18, the fabric web 10 is substantially fluid-tight. In this case, openings 30 to 36 are closed. The opening 34 is described here as representative of the openings 30, 32 and 36, which are of the same construction. It is delimited by the cut edge 27 of the main fabric layer 20 and by the underside 28 of the fabric tongue 16.

FIGS. 3 and 4 depict the fabric web 10 of FIGS. 1 and 2 at increased temperature.

When the temperature of the textile material of the fabric web 10 is increased, the material layer 11*a* of the composite structure of the fabric web 10 (cf. FIG. 5) expands more than the material layer 11*b*. This causes bending of the fabric tongues 12 to 18, which constitute a first type of control element for controlling the fluid permeability in the fabric web 10. The openings 30 to 36 of the main fabric layer 20, which scarcely bends even at increased temperature due to a bordering, not depicted, of the edge of the fabric web 10 and due to additional forces having a stabilizing effect on the main fabric layer 20, form a second type of control element in the fabric web 10.

As a result of the temperature increase, all of the fabric tongues 12 to 18 bend and the cut edge 24 lifts away from the main fabric layer 20, as can be seen from FIG. 4. Depending on the magnitude of the temperature increase, the fabric tongues 12 to 18 then uncover the openings 30 to 36 to a greater or lesser extent.

The uncovering of the openings 30 to 36 has the effect of enabling fluid to pass through the fabric web 10.

A further embodiment example, which is similar to that of FIGS. 1 to 4, is now described with reference to FIG. 5. The constitution of the textile material and the dimensions of the fabric tongues are selected so that the fabric tongues 12 to 18 can move into the main fabric layer 20.

Elements which correspond to those of FIGS. 1 and 2 have the same reference numbers in FIG. 5 and do not need to be described again in detail.

The fabric tongues 16, 18 of the fabric web 10 of FIG. 5 have been produced, like those of FIGS. 1 to 4, by substantially rectangular U-shaped cuts in the main fabric layer 20. Unlike the fabric web 10 of FIGS. 1 and 2, the fabric tongues 16, 18 lie in such a way in the main fabric layer 20, in a temperature range in which no mechanical stresses or other thermally induced forces operate, that the upper sides and undersides of the fabric tongues 16, 18 are flush with those of the main fabric layer 20. The cut edges 22 to 26 of the fabric tongues 16, 18 lie, substantially, closely opposite the cut edge 27 of the main fabric layer 20.

In the case of a temperature increase, the fabric tongues 16, 18 of FIG. 5 bend away from the surface of the main fabric layer 20. The fabric web 10 is then more permeable.

Through the choice of the temperature at which the material layers 11*a,* 11*b* are joined together (joining temperature), it is possible to achieve a fluid permeability characteristic of the fabric web 10 at which the fluid permeability of the fabric web 10 increases both towards higher and towards lower temperatures. In the case of cooling below the joining temperature, the fabric tongues 12 to 18 are raised in the direction opposite to that shown in FIGS. 2 and 4 in the case of the temperature increase. In this case, likewise, the openings 30 to 36 are uncovered, so that fluid can penetrate the fabric web 10.

If such a permeability characteristic with an increase of the permeability below the joining temperature is not desired, such a low value is selected for the latter that, when the textile is worn, the temperature of the material does not fall below the joining temperature to such an extent that the permeability is increased even in the case of temperatures lower than the joining temperature.

Alteratively, bending of the fabric tongue towards the second side (to the left in FIG. 5) can be prevented by stops provided for each fabric tongue in the main fabric layer 20. Such a stop can already be provided by, for example, the cut edge 27, as shown in FIGS. 1 to 4.

Further embodiment examples are described in FIGS. 6 to 18. Here again, elements which correspond to those of the embodiments already described are denoted by the same reference numbers.

Figure 6:
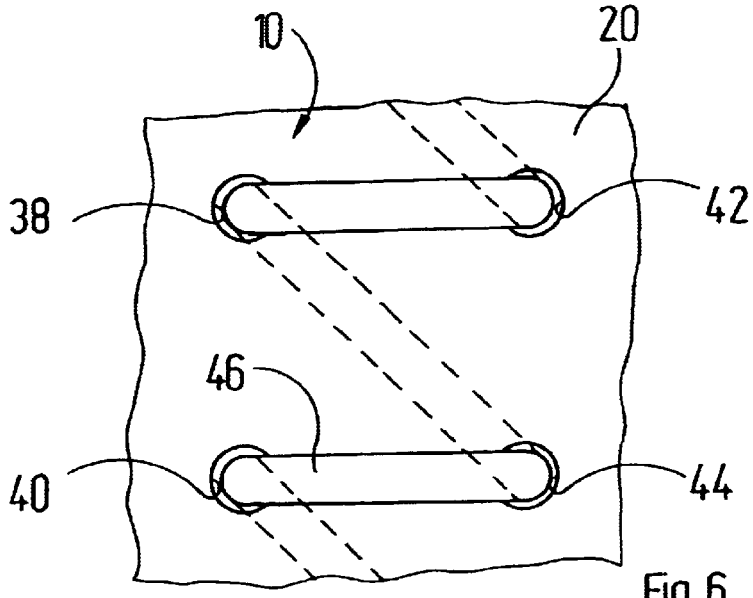
FIG. 6 shows a greatly enlarged top-view of a piece of a textile fabric web according to a further embodiment of the invention.

The piece of a fabric web 10 shown in FIG. 6 has a main fabric layer 20 of a fluid-tight material with a relatively low thermal expansion coefficient. The piece shown has four holes 38 to 44. There is a control thread 46 drawn through the holes 38 to 44, in a manner similar to a zig-zag seam, in such a way that it passes once though each hole 38 to 44.

The control thread 46 is produced from a material which has a low permeability to fluid or is impermeable to fluid and, by comparison with the main fabric layer 20, it has a high thermal expansion coefficient. In this embodiment example, the control thread 46 and the openings 38 to 44 form the two types of control elements which define the fluid permeability of the fabric web 10.

Figure 7:
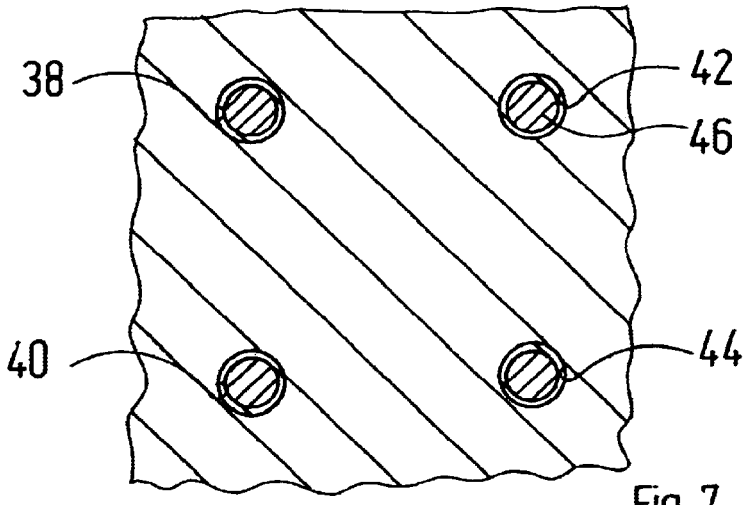
FIG. 7 shows a section through the fabric web of FIG. 6 in a centre plane which runs parallel to the surface of the fabric web.

The sectional representation of FIG. 7 shows a section through the centre plane of the fabric web of FIG. 6. In the case of the fabric web 10 represented in FIGS. 6 and 7, the diameter of the control thread 46 is smaller than the diameter of the holes 38 to 44. A substantially circular gap therefore remains in each case between the edges of the holes 38 to 44 and the outer face of the control thread 46. This distance between the control thread 46 and the edges of the holes 38 to 44 is sufficiently large to enable fluid, e.g. water or water vapour, to pass through the gap.

Figure 8:
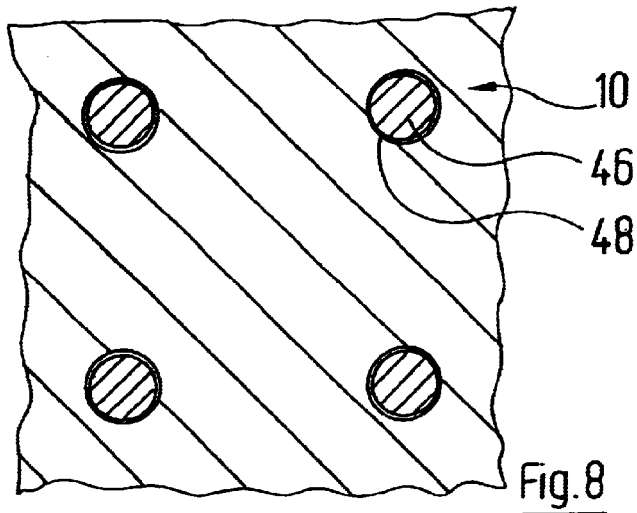
FIG. 8 shows a section as in FIG. 7, in which the fabric web of FIGS. 6 and 7 has been brought to an increased temperature.

FIG. 8 depicts the fabric web 10 of FIGS. 6 and 7 at increased temperature. Under the influence of the increased temperature, the control thread 46 has expanded so that, in particular, its diameter has become larger. As a result, the outer circumferential surface 48 of the control yarn 46 now lies close against the edges of the openings 38 to 44, so that the latter are closed in a substantially fluid-tight manner.

Figure 9:
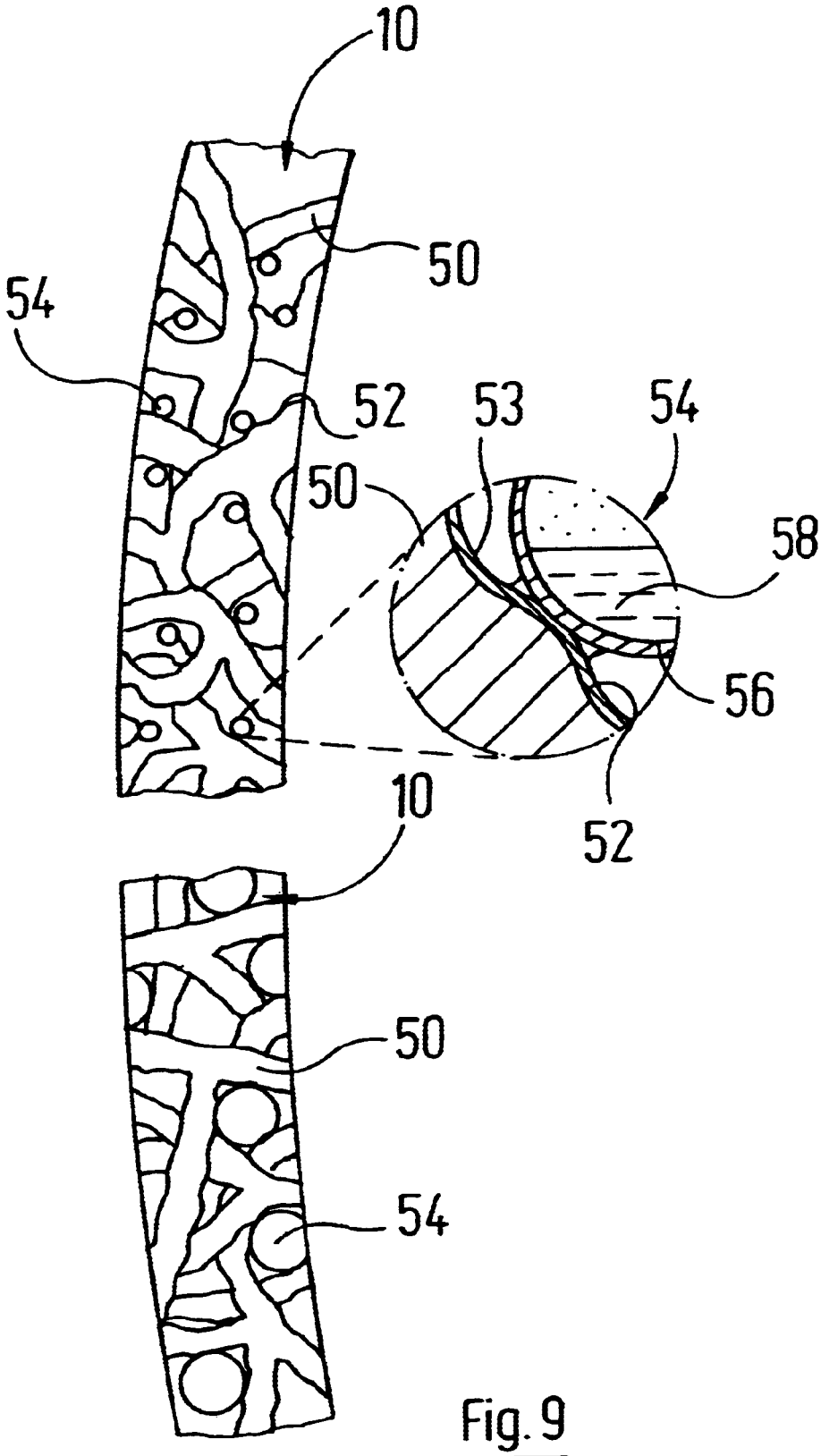
FIG. 9 shows a schematic and greatly enlarged sectional view perpendicular to the surface of a textile fabric web according to a further embodiment of the invention.

A further embodiment is shown in FIG. 9. This depicts a schematic, greatly enlarged section perpendicular to the plane of a fabric web 10 with fabric fibres 50 made from a fluid-tight textile material with a low thermal expansion coefficient. The upper portion of the sectional representation shows the fabric web 10 at approximately 25° C.

As can be seen particularly from the enlarged section in FIG. 9, there is adhering to the outer face 52 of the fabric fibres 50, by means of a bonding medium 53, a plurality of micro-capsules 54. The latter are blown, when the bonding medium 53 is moist, on to the fabric fibres 50 coated with the bonding medium.

The micro-capsules 54 each comprise an enclosure 56 of an elastic material and a filling 58 of fluid and vapour of an alcohol/water mixture. The enclosure is impermeable to the content of the capsule.

When the temperature of the textile material is increased, e.g. through an increase of the ambient temperature to 35° C., the vapour pressure of the filling 58 increases so that the elastic enclosure 56 is expanded, in a manner similar to an air balloon, thus enlarging the diameter of the micro-capsule 54. Due to the elasticity of the enclosure 56, the enlargement, or reduction, of the size of the micro-capsules 54, which is dependent on the vapour pressure of the filling 58, is reversible.

In the upper representation of FIG. 9, the diameter of the micro-capsule 54 is small in relation to the typical distance between the fabric fibres 50. Fluid can therefore pass through the gaps remaining between the fabric fibres 50 and, consequently, through the fabric web 10.

The lower part of FIG. 9 shows a piece of the fabric web 10 at increased temperature. Whereas the fabric fibres 50 and also the gaps formed between them have not altered substantially in their extent, the diameter of the micro-capsules 54 has increased significantly under the influence of the temperature (by a factor of 3 in the representation). Consequently, the diameter of the micro-capsules 54 is now of the order of magnitude of the gaps between the fabric fibres 50. The connecting channels between the surfaces of the fabric web 10 which run through these gaps are therefore reduced by the micro-capsules 54. As a result, as the temperature increases there is an ever-decreasing amount of the fabric web 10 that is permeable to fluid.

Figure 10:
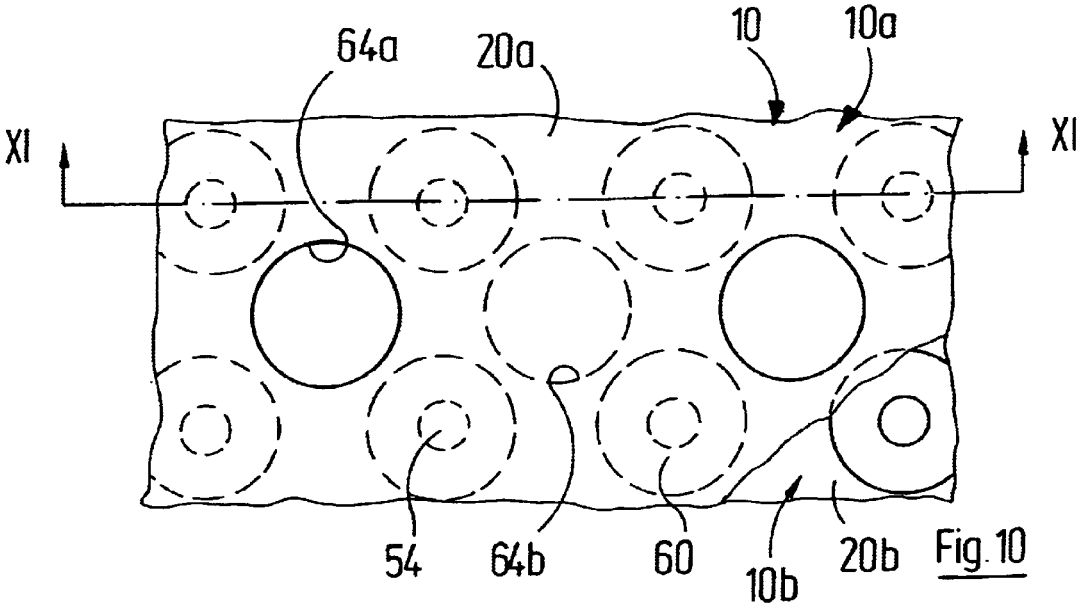
FIG. 10 shows a greatly enlarged and partially exploded top-view of a piece of a textile fabric web according to a further embodiment of the invention.
Figure 11:
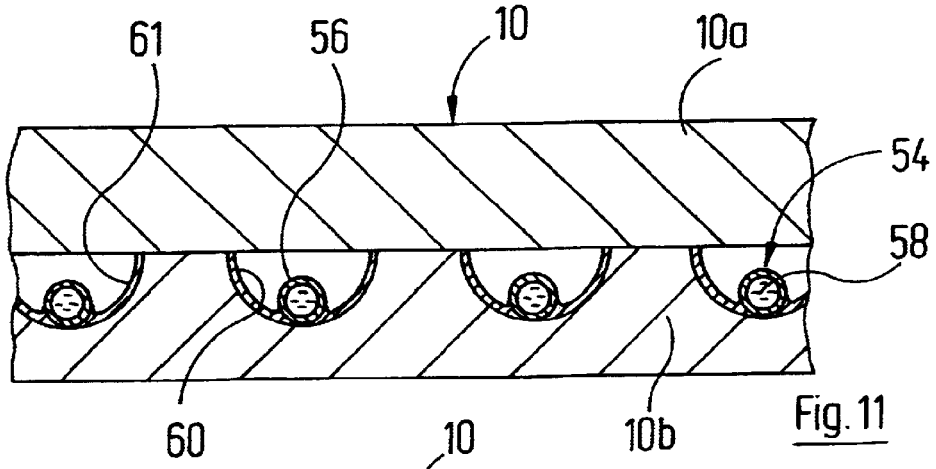
FIG. 11 shows a section along line XI—XI of FIG. 10.
Figure 12:
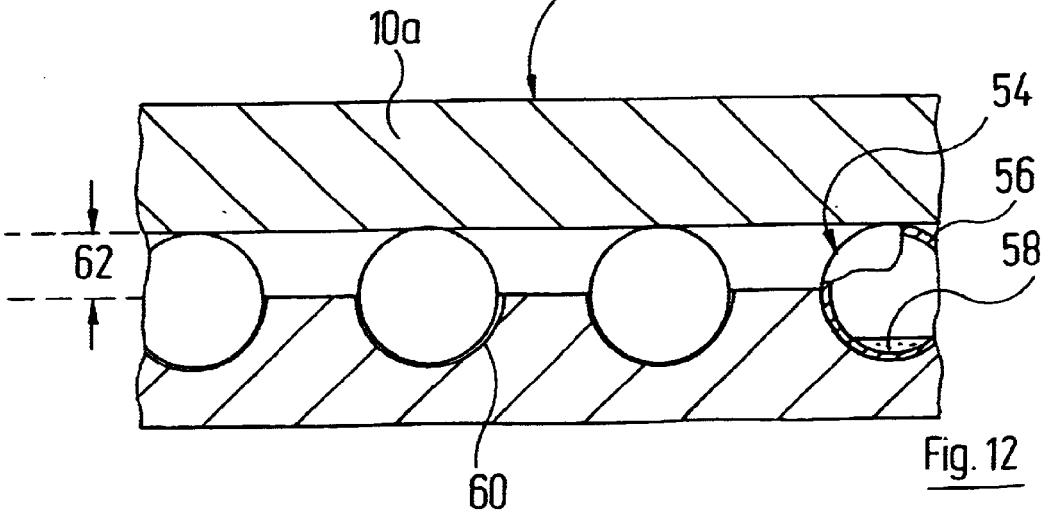
FIG. 12 shows a section as in FIG. 11, in which the fabric web of FIGS. 10 and 11 has been brought to an increased temperature.

A further embodiment of the invention is depicted in FIGS. 10 to 12. Here, the fabric web 10 is constructed from two fabric web layers 10*a*, 10*b* lying flat on one another, with main fabric layers 20*a*, 20*b*, regions of the upper fabric web 10*a* being broken away so that the fabric web 10*b* under them is uncovered.

The main fabric layers 20*a*, 20*b* are composed of a material which is impermeable to fluid, with preferably a low thermal expansion coefficient, and are welded together at the edges by means of weld seams which are not depicted in the drawing. By this means, and by gravity, a force is exerted on the fabric webs 10*a*, 10*b*, acting perpendicularly to their surfaces, so that in the absence of further influences they lie flat on one another, as shown in FIG. 11.

The fabric web layer 10*b* comprises hemispherical recesses 60, disposed in a square matrix, which can be produced by, for example, stamping with an appropriately shaped stamping cylinder. In these recesses, micro-capsules 54 adhere by means of a bonding medium 61 applied to the surface of the recesses 60, the micro-capsules 54 having been blown on to the moist bonding medium. The conditions at the boundary layer between a micro-capsule 54 and the surface of a recess 60 are comparable to those depicted in the enlarged section of the embodiment example shown in FIG. 9.

At the relatively low temperature of FIG. 11, the micro-capsules 54 lie fully within the recesses 60.

FIG. 12 depicts the fabric web 10 at a temperature which has been increased by comparison with FIG. 11. Under the influence of the temperature increase, the diameter of the micro-capsules 54 has approximately tripled due to the increased vapour pressure of its gas filling. The thus enlarged micro-capsules 54 now project out over the surface of the fabric web layer 10*b* and force the two fabric web layers 10*a*, 10*b* apart from one another, by a distance 62.

As can be seen from FIG. 10, the fabric web layers 10*a*, 10*b* comprise passage openings 64*a*, 64*b*. The passage openings 64*a* of the fabric web 10*a* are offset in relation to the passage openings 64*b* of the fabric web 10*b* so that they do not overlap, as evident from the top-view shown in FIG. 10. The recesses 60 are disposed equidistantly around the circumference of the passage openings 64*b*, in a square matrix.

The fabric web 10 of FIGS. 10 to 12 with controllable permeability functions as follows:

When the micro-capsules 54 are enlarged by a temperature increase so that they force the fabric web layers 10*a*, 10*b* apart from one another (e.g. distance 62 in FIG. 12), a plurality of passage channels is produced in the fabric web 10, due to the fact that the passage openings 64*a*, 64*b* which are offset in relation to one another now interconnect via the fabric web layers 10*a*, 10*b* which are separated from one another. Fluid can then penetrate the fabric web 10, through the channels that are produced.

On cooling, the micro-capsules 54 diminish in size due to the diminishing vapour pressure. The micro-capsules 54 then become smaller, the distance between the fabric web layers 10*a*, 10*b* and, consequently, the permeability of the fabric web 10 also being reduced. When the micro-capsules 54 have retracted back into the recesses 60 the fabric webs 10*a*, 10*b* again lie close and flat on one another.

Figure 14:
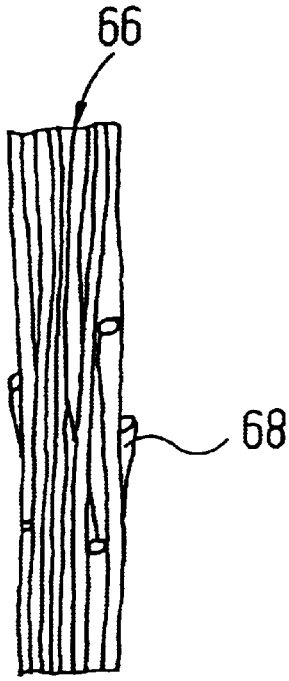
FIG. 14 shows a view of the thread according to FIG. 13, at a lower temperature.

FIG. 14 shows a thread 66 which can serve as a starting material for a fabric with a permeability which can be controlled by temperature or also as an alternative to the control thread 46 in the embodiment of FIGS. 6 to 8. The thread 66 is constructed from a plurality of individual short fibres 68, which can be specially modified composite natural fibres or composite fibres produced from impermeable synthetic material.

Figure 15:
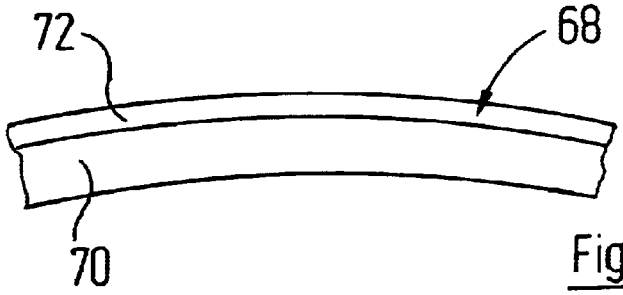
FIG. 15 shows a further enlarged view of a portion of a single fibre which is part of the fibre bundle of FIGS. 13 and 14.

FIG. 15 shows a detail view of such a fibre 68. It comprises a main fibre 70 and a control fibre 72, shown as thinner in this case. The main fibre 70 and the control fibre 72 are bonded together longitudinally.

The control fibre 72 has a greater temperature expansion coefficient than the main fibre 70. At the temperature at which the main fibre 70 and the control fibre 72 were bonded together, they do not exert on one another any forces resulting from thermal longitudinal deformation, so that the overall result is a substantially straight fibre 60. The substantially straight fibres 68 form the substantially smooth thread 66 of FIG. 14.

Figure 13:
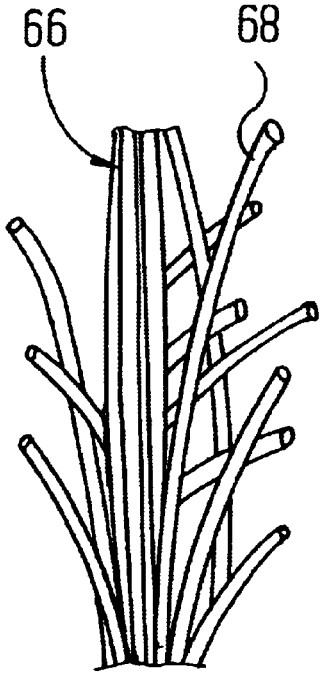
FIG. 13 shows greatly enlarged view of a thread for the production of a fabric.

The inside diameter of the thread 66 is smaller than that of the thread 66 depicted in FIG. 13, the temperature of which is increased relative to that of the thread 66 of FIG. 14. The control thread 72 has expanded more, particularly in the longitudinal direction, than the main thread 70, so that the fibres 68 have developed a curvature, in a manner similar to the case of a bimetal. The result is the unravelling of the thread 66 shown in FIG. 13, with an enlargement of the inside diameter.

When unravelled in such a manner, the thread 66 in a fabric closes to a greater extent the gaps remaining between the weft and warp or, if it is used as a control thread 46 according to FIGS. 6 to 8, it closes to a greater extent the openings 38 to 44 present in the fabric web 10, so that a fabric web 10 which previously had good fluid permeability becomes less permeable to fluid.

In the case of a temperature which is reduced in relation to the bonding temperature, the control fibre 72 contracts more than the main fibre 70, likewise resulting in bending of the fibres 68 and unravelling, as depicted in FIG. 13.

Thus, through the choice of the temperature at which the main fibre 70 and the control fibre 72 are bonded together, within a predefined temperature operating range it is possible to achieve, analogous to the permeability characteristic of the joined material layers 11*a*, 11*b* of FIGS. 1 to 5, in the case of an increase of temperature, either an increase or decrease of the fluid permeability of a fabric web 10 according to FIGS. 6 to 8 comprising such threads 66, depending on whether the bonding temperature is below or above the temperature operating range.

Figure 16:
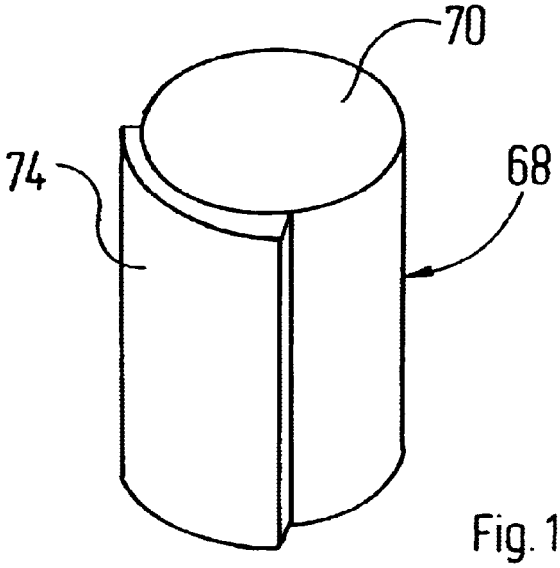
FIG. 16 shows a portion of a fibre according to a further embodiment of the invention.

A further embodiment of a fibre 68 is shown in FIG. 16. Here, the fibre 68 comprises a main fibre 70 which is provided with a lacquer coating 74 extending over only a portion of the circumference of the fibre.

The material of the lacquer coating 74 can differ from the material of the main fibre 70 in respect of its thermal expansion coefficient. A structure similar to a bimetal is then achieved which responds to temperature variations. The material can also differ from the material of the main fibre 70 in respect of its capacity to swell in a humid environment. A structure similar to a bimetal is then achieved which responds to humidity variations. The material of the lacquer coating 74 can also effect only direct blocking of moisture, so that humidity variations in the environment have less effect in the covered regions of the fibre that in the non-covered regions, so that again moisture-induced deformations of the main fibre 70 are achieved.

The above-mentioned effects can also be used in combination in order to achieve a fabric web permeability which is dependent on both the temperature and the humidity.

Alternatively, the lacquer coating 74 can also be applied so that it is distributed with a layer thickness which varies over the circumference of the main fibre 70. This results, likewise, in a temperature- or humidity-dependent bimetal effect, as described in connection with the fibre 68 in FIGS. 13 to 15. The lacquer coating 74 in this case assumes the role of the control fibre 72.

Such an uneven application of the lacquer coating 74 can be achieved in that, for example, following immersion in a fluid lacquer, the main fibres 70 are dried, freely suspended, in a horizontal orientation, so that under the influence of gravity there is a greater accumulation of the lacquer on that portion of the surface of the main fibre 70 which faces the floor. Following drying of the lacquer coating 74, a fibre 68 is obtained with a lacquer coating 74 which is thicker on one side. The temperature- or humidity-dependent expansion effects of the thicker lacquer coating side then prevail and result in the bimetal effect described above.

In the case of a further embodiment, the fabric tongues 12 to 18 of FIGS. 1 to 5 are also provided with such a lacquer coating, so that instead of or in addition to bending in dependence on temperature, they also bend in dependence on an air humidity variation and thus render the fabric web 10 permeable to fluid.

Figure 17:
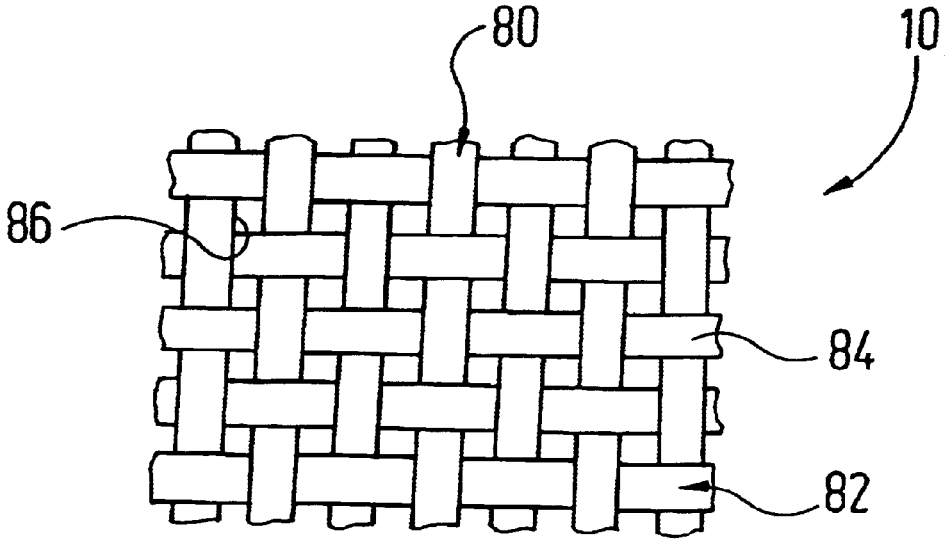
FIG. 17 shows a greatly enlarged top-view of a piece of a textile fabric web according to a further embodiment of the invention.
Figure 18:
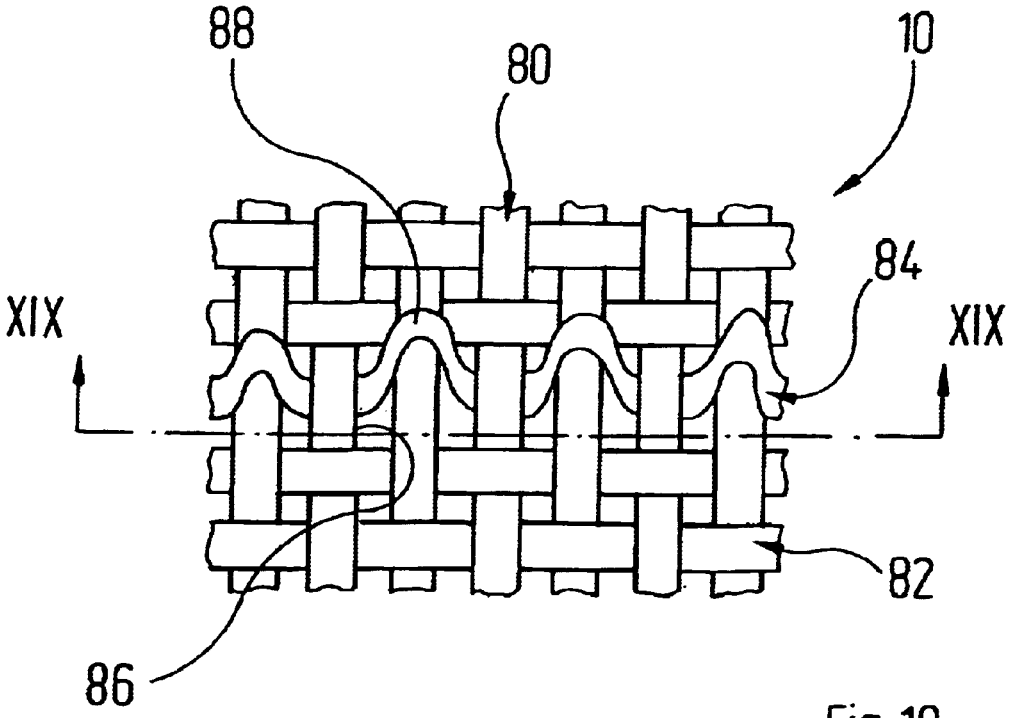
FIG. 18 shows a top-view of the fabric web of FIG. 17 after it has been subjected to an increased temperature.

The fabric web 10 of the further embodiment of the invention, depicted in FIGS. 17 and 18, comprises warp threads 80 and weft threads 82.

In the case of a first temperature of the fabric web 10, depicted in FIG. 17, the warp threads 80 and the weft threads 82 from a fabric which is substantially fluid-tight, the size of the gaps 86, which in each case remain between two adjacent warp threads 80 and two likewise adjacent weft threads 82 crossing the latter and which in the top-view shown are substantially square, being exaggerated in the depiction in FIGS. 17 and 18. The fabric web 10 of FIG. 17 is thus substantially fluid-tight.

The group of the weft threads 82 comprises control weft threads, of which one control weft thread 84 is depicted in FIGS. 17 and 18. This, unlike the other depicted weft threads 82 and warp threads 80, is made from a material which is substantially uninfluenced by an environmental parameter variation.

Figure 19:
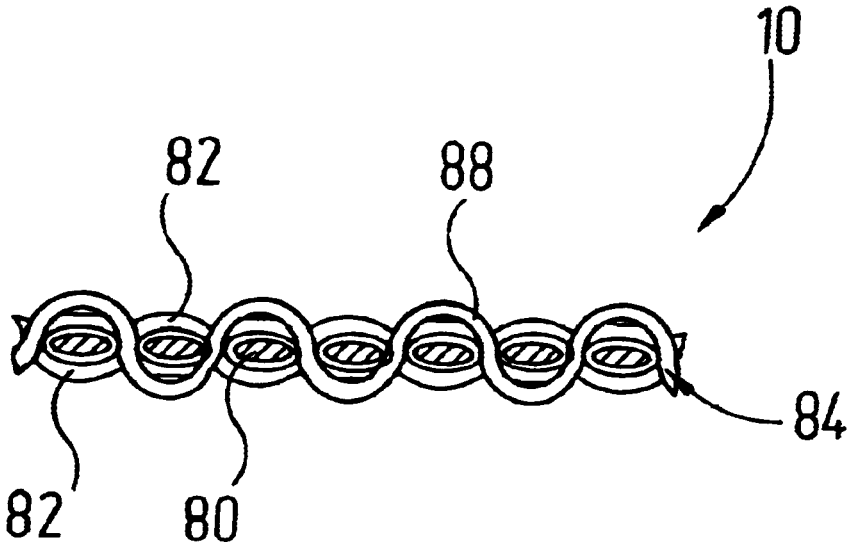
FIG. 19 shows a section through FIG. 18 along line XIX—XIX of FIG. 18.

FIG. 18 depicts the fabric web 10 at a temperature which has been increased in relation to that of FIG. 17. Due to this temperature increase, the control weft thread 84 has become elongated in relation to the other threads. Consequently, in the weave of the fabric web 10, between each two warp threads 80 disposed on either side of a third warp thread 80, the control weft thread 84 forms loops 88 which protrude in the form of a nap from the plane of the fabric web 10. The sectional representation of FIG. 19 shows that the loops 88 of the elongated control weft thread 84 extend alternately upwards and downwards. Due to the fact that the loops 88 no longer lie directly on the warp threads 80, a gap remaining instead between the warp thread 80 and the control thread 84 in the region of the loops 88, the fluid permeability of the fabric web increases in the area around the gaps 86, in the vicinity of the loops 88. The fabric web is then permeable to fluid at the temperature as depicted in FIG. 18.

The elongation of the control weft thread 84 can be effected, either alternatively or additionally, by swelling in the case of increased air humidity.

The control thread 46, the fibre 68 or the control thread 84 can be made as monofilament synthetic fibres. Monofilament fibres differ from multifilament fibres in respect of both their temperature behaviour and their swelling behaviour. This difference can obviously also be exploited analogously, in that the control threads are produced from multifilament fibres and the remaining textile material is produced from monofilament fibres.

The textile material can also be made as a stretch fabric. Different expansion coefficients, dependent on environmental parameters, can be achieved through the texturing of synthetic fibres or through a corresponding process, e.g. for cotton.

If the fabric web 10 is a knit fabric, control threads of the type of the control thread 84 can be knit-in, in that, in the case of a knitting machine which, for example, simultaneously knits 24 threads to produce the knit fabric, some of these 24 threads, for example five, are fashioned as control threads, i.e., they are composed of a material with an expansion coefficient which is dependent on environmental parameters.

The controllable permeability of fabric webs described above is fluid permeability. It is understood that this also at the same time includes other permeabilities, e.g. permeability to light. Thus, for example, awnings or suchlike can be produced which afford a predefined brightness under the awning, irrespective of the intensity of the sun.

What is claimed is:

1. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), which are deformable in relation to one another by the environmental parameter for the purpose of opening or closing a passage to a greater or lesser extent, and wherein amongst the control components are openings (64), offset in relation to one another, which are fashioned in two layers of material (20*a*, 20*b*) which are movable between a blocking position, in which they lie flat over one another, and a separated transmitting position.

2. A textile material as claimed in claim 1, wherein the first control elements (46; 54) and second control elements (38 to 44; 50; 64) are of different material.

3. A textile material as claimed in claim 1, wherein the first control elements (12 to 18; 46; 54) and second control elements (30 to 36; 38 to 44; 50; 64) are of different shape.

4. A textile material as claimed in claim 1, wherein the control components (12 to 18; 54; 68) comprise two layers, joined together, (11*a*, 11*b*, 56, 58; 70, 72; 70, 74), of materials which differ from one another in their expansion that is dependent on the environmental parameter.

5. A textile material as claimed in claim 1, wherein the control components comprise capsules/micro-capsules (54) with an elastic enclosure (56) and a filling (58) whose volume varies with temperature variation.

6. A textile material as claimed in claim 5, wherein the filling (58) of the capsules/micro-capsules (54) is a fluid with a boiling-point temperature of between 20 and 50° C., preferably approximately 30° C.

7. A textile material as claimed in claim 5, wherein the capsules/micro-capsules (54) are joined to fibres (50) of the material by means of a bonding medium (53).

8. A textile material as claimed in claim 5, wherein the capsules/microcapules (54) which effect the relative movement of the layers of material (20*a*, 20*b*) are disposed in recesses (60) which are provided in at least one of the two layers of material (20*a*, 20*b*).

9. A textile material as claimed in claim 5, wherein the capsules/micro-capsules (54), is an expanded state, substantially fill the gaps in a fibre fabric formed by a plurality of fluid-permeable fabric fibres (50).

10. A textile material as claimed in claim 1 wherein the two layers of materials (20*a*, 20*b*) are joined together in regions.

11. A textile material as claimed in claim 1, wherein amongst the control components are control threads (66) with a plurality of fibres (68), at least a portion of the fibres having a deformation which is dependent on at least one environmental parameter.

12. A textile material as claimed in claim 11, wherein the fibres (68) which have a deformation which is dependent on at least one environmental parameter each comprise at least two fibre elements (70, 72; 70, 74) which are joined together longitudinally and differ from one another in their longitudinal expansion that is dependent on the environmental parameter.

13. A textile material as claimed in claim 12, wherein one of the thread elements is a lacquer coating (74) whose thickness varies in the circumferential direction of the fibre (68).

14. A textile material as claimed in claim 11, wherein the fibres (68) comprise a material which responds to an environmental parameter and have on their circumferential surface a blocking coating (74) whose thickness varies in the circumferential direction of the fibre (68) and which at least partially shields the fibre material against the environmental parameter.

15. A textile material as claimed in claim 1, wherein it consists, at least in portions, of a knit fabric into which are knit control threads whose length varies in dependence on at least one environmental parameter.

16. A textile material as claimed in claim 1, wherein at least a portion of the control components (4; 68; 84) is made as monofilament synthetic threads.

17. A textile material as claimed in claim 16, wherein a further portion of the control components (80, 82) is made as multifilament synthetic threads, the multifilament and the monofilament synthetic threads preferably being composed of the same material.

18. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), which are deformable in relation to one another by the environmental parameter for the purpose of opening or closing a passage to a greater or lesser extent wherein the material has a weave of warp threads (80) and weft threads (82), which, at least in regions, comprises control threads (84) whose length varies in dependence on at least one environmental parameter, wherein it consists, at least in portions, of a knit fabric into which are knit control threads whose length varies in dependence on at least one environmental parameter.

19. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), which are deformable in relation to one another by the environmental parameter for the purpose of opening or closing a passage to a greater or lesser extent wherein the material has a weave of warp threads (80) and weft threads (82) which, at least in regions, comprises control threads (84) whose length varies in dependence on at least one environmental parameter, wherein at least a portion of the control components (46; 68; 84) are made as monofilament synthetic threads.

20. A textile material as claimed in claim 19, wherein a further portion of the control components (80, 82) is made as multifilament synthetic threads, the multifilament and monofilament synthetic threads preferably being composed of the same material.

21. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86) which are deformable in relation to one another by the environmental parameter for the purpose of opening or closing a passage to a greater or lesser extent wherein the material has a weave of warp threads (80) and weft threads (82) which, at least in regions, comprises control threads (84) whose length varies in dependence on at least one environmental parameter, wherein the first control elements (26; 54) and second control elements (38 to 44; 50; 64) are of different material.

22. A textile material as claimed in claim 21, wherein the first control component (54) comprises capsules/micro-capsules (54) with an elastic enclosure (56) and a filling (58) whose volume varies with temperature variation.

23. A textile material as claimed in claim 22, wherein the filling (58) of the capsules/microcapsules (54) is a fluid with a boiling-point temperature of between 20 and 50° C., preferably approximately 30° C.

24. A textile material as claimed in claim 22, wherein the capsules/micro-capsules (54) are joined to fibres (50) of the material by means of a bonding medium (53).

25. A textile material as claimed in claim 22, wherein the capsules/micro-capsules (54), in an expanded state, subsequently fill the gaps in a fibre fabric formed by a plurality of fluid-permeable fabric fibres (50).

26. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), which are deformable in relation to one another by the environmental parameter for the purpose of opening or closing a passage to a greater or lesser extent wherein the material has a weave of warp threads (80) and weft threads (82) which, at least in regions, comprises control threads (84) whose length varies in dependence on at least one environmental parameter, wherein the first control elements (12 to 18; 46; 54) and second control elements (30 to 36; 38 to 44; 50; 64) are of different shape.

27. A textile material as claimed in claim 26, wherein amongst the control components are control threads (66) with a plurality of fibres (68), at least a portion of the fibres (68) having a deformation which is dependent on at least one environmental parameter.

28. A textile material as claimed in claim 27, wherein the fibres (68) which have a deformation which is dependent on at least one environmental parameter each comprise at least two fibre elements (70, 72; 70, 74) which are joined together longitudinally and differ from one another in their longitudinal expansion that is dependent on the environmental parameter.

29. A textile material as claimed in claim 28, wherein one of the threads elements is a lacquer coating (74) whose thickness varies in the circumferential direction of the fibre (68).

30. A textile material as claimed in claim 27, wherein the fibres (68) comprise a material which responds to an environmental parameter and have on their circumferential surface a blocking coating (74) whose thickness varies in the circumferential direction of the fibre (68) and which at least partially shields the fibre material against the environmental parameter.

31. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), which are deformable in relation to one another by the environmental parameter for the purpose of opening or closing a passage to a greater or lesser extent wherein the material has a weave of warp threads (80) and weft threads (82) which, at least in regions, comprises control threads (84) whose length varies in dependence on at least one environmental parameter, wherein the control elements (12 to 18; 54; 68) comprise two layers, joined together, (11*a*, 11*b*, 56, 58; 70, 72; 70, 74), of materials which differ from one another in their expansion that is dependent on the environmental parameter.

32. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 86), made of different materials, which are deformable in relation to one another by the environmental parameter for the purpose of opening or closing a passage to a greater or lesser extent wherein amongst the first control elements are material tongues (12 to 18) which work together with the openings (30 to 36) of a main material layer (20) which form the second control elements, the material tongues (12 to 18) being dimensioned so that the openings (30 to 36) are closed by them when the material tongues (12 to 18) are, in essence, stretched.

33. A textile material as claimed in claim 32, wherein the first control elements (12 to 18; 46; 54) and second control elements (30 to 36; 38 to 44; 50; 64) are of different shape.

34. A textile material as claimed in claim 32, wherein the control elements (12 to 18; 54; 68) comprise two layers, joined together, (11*a*, 11*b*, 56, 58; 70, 72; 70, 74), of materials which differ from one another in their expansion that is dependent on the environmental parameter.

35. A textile material as claimed in claim 33, wherein the control components comprise capsules/micro-capsules (54) with an elastic enclosure (56) and a filling (58) whose volume varies with temperature variation.

36. A textile material as claimed in claim 35, wherein the filling (58) of the capsules/microcapsules (54) is a fluid with a boiling-point temperature of between 20 and 50° C., preferably approximately 30° C.

37. A textile material as claimed in claim 35, wherein the capsules/micro-capsules (54) are joined to fibres (50) of the material by means of a bonding medium (53).

38. A textile material as claimed in claim 35, wherein the capsules/micro-capsules (54), in an expanded state, subsequently fill the gaps in a fibre fabric formed by a plurality of fluid-permeable fabric fibres (50).

39. A textile material as claimed in claim 32, wherein amongst the control components are control threads (66) with a plurality of fibres (68), at least a portion of the fibres (68) having a deformation which is dependent on at least one environmental parameter.

40. A textile material as claimed in claim 39, wherein the fibres (68) which have a deformation which is dependent on at least one environmental parameter each comprise at least two fibre elements (70, 72; 70, 74) which are joined together longitudinally and differ from one another in their longitudinal expansion that is dependent on the environmental parameter.

41. A textile material as claimed in claim 40, wherein one of the thread elements is a lacquer coating (74) whose thickness varies in the circumferential direction of the fibre (68).

42. A textile material as claimed in claim 39, wherein the fibres (68) comprise a material which responds to an environmental parameter and have on their circumferential surface a blocking coating (74) whose thickness varies in the circumferential direction of the fibre (68) and which at least partially shields the fibre material against the environmental parameter.

43. A textile material as claimed in claim 32, wherein it consists, at least in portions, of a knit fabric into which are knit control threads whose length varies in dependence on at least one environmental parameter.

44. A textile material as claimed in claim 32, wherein at least a portion of the control components (46; 68; 84) are made as monofilament synthetic threads.

45. A textile material as claimed in claim 44, wherein a further portion of the control components (80, 82) is made as multifilament synthetic threads, the multifilament and monofilament synthetic threads preferably being composed of the same material.

46. A flat textile material, particularly for use as a clothing, lining or fleece fabric, with an upper side and an underside, wherein it comprises control components (30 to 36, 12 to 18; 38 to 44, 46; 50, 54; 64, 54; 84) which control the permeability of the textile material and which are deformable by at least one environmental parameter, the control components comprising pairs of interworking first control elements (12 to 18; 46; 54, 84) and second control elements (30 to 36; 38 to 44; 50; 64; 84), which are deformable in relation to one another by the environmental parameter for the purpose of opening or closing a passage to a greater or lesser extent wherein a main material layer (20) comprises openings (38 to 44) therethrough, and wherein interspersed amongst the first control elements are control threads (46; 66) which extend through the openings (38 to 44) in a perpendicular direction to a plane of the openings (38 to 44).

47. A textile material as claimed in claim 46, wherein the first control elements (26; 54) and second control elements (38 to 44; 50; 64) are of different material.

48. A textile material as claimed in claim 46, wherein the first control elements (12 to 18; 46; 54) and second control elements (30 to 36; 38 to 44; 50; 64) are of different shape.

49. A textile material as claimed in claim 46, wherein the control elements (12 to 18; 54; 68) comprise two layers, joined together (11*a,* 11*b;* 56; 58; 70, 72; 70, 74), of materials which differ from one another in their expansion that is dependent on the environmental parameter.

50. A textile material as claimed in claim 46, wherein the control components comprise capsules/micro-capsules (54) with an elastic enclosure (56) and a filling (58) whose volume varies with temperature variation.

51. A textile material as claimed in claim 50, wherein the filling (58) of the capsules/microcapsules (54) is a fluid with a boiling-point temperature of between 20 and 50° C., preferably approximately 30° C.

52. A textile material as claimed in claim 50, wherein the capsules/micro-capsules (54) are joined to fibres (50) of the material by means of a bonding medium (53).

53. A textile material as claimed in claim 50, wherein the capsules/micro-capsules (54), in an expanded state, subsequently fill the gaps in a fibre fabric formed by a plurality of fluid-permeable fabric fibres (50).

54. A textile material as claimed in claim 46, wherein amongst the control components are control threads (66) with a plurality of fibres (68), at least a portion of the fibres (68) having a deformation which is dependent on at least one environmental parameter.

55. A textile material as claimed in claim 54, wherein the fibres (68) which have a deformation which is dependent on at least one environmental parameter each comprise at least two fibre elements (70, 72; 70, 74) which are joined together longitudinally and differ from one another in their longitudinal expansion that is dependent on the environmental parameter.

56. A textile material as claimed in claim 55, wherein one of the thread elements is a lacquer coating (74) whose thickness varies in the circumferential direction of the fibre (68).

57. A textile material as claimed in claim 54, wherein the fibres (68) comprise a material which responds to an environmental parameter and have on their circumferential surface a blocking coating (74) whose thickness varies in the circumferential direction of the fibre (68) and which at least partially shields the fibre material against the environmental parameter.

58. A textile material as claimed in claim 46, wherein it consists, at least in portions, of a knit fabric into which are knit control threads whose length varies in dependence on at least one environmental parameter.

59. A textile material as claimed in claim 46, wherein at least a portion of the control components (46; 68; 84) are made as monofilament synthetic threads.

60. A textile material as claimed in claim 59, wherein a further portion of the control components (80, 82) is made as multifilament synthetic threads, the multifilament and monofilament synthetic threads preferably being composed of the same material.

* * * * *

UNITED STATES PATENT AND TRADEMARK OFFICE

CERTIFICATE OF CORRECTION

PATENT NO. : 6,767,850 B1
DATED : July 27, 2004
INVENTOR(S) : Gerold Tebbe

It is certified that error appears in the above-identified patent and that said Letters Patent is hereby corrected as shown below:

Column 15,
Line 53, delete “84” and insert instead -- 86 --.

Signed and Sealed this

Twenty-first Day of December, 2004

JON W. DUDAS
*Director of the United States Patent and Trademark Office*